US007726928B2

(12) United States Patent
Kurabayashi et al.

(10) Patent No.: US 7,726,928 B2
(45) Date of Patent: Jun. 1, 2010

(54) BINDING PROCESSING APPARATUS

(75) Inventors: Atsushi Kurabayashi, Tokyo (JP); Toru Yoshie, Tokyo (JP); Takao Hasegawa, Tokyo (JP)

(73) Assignee: Max Co., Ltd., Tokyo (JP)

( * ) Notice: Subject to any disclaimer, the term of this patent is extended or adjusted under 35 U.S.C. 154(b) by 655 days.

(21) Appl. No.: 10/571,754

(22) PCT Filed: Nov. 10, 2004

(86) PCT No.: PCT/JP2004/016648

§ 371 (c)(1),
(2), (4) Date: Mar. 13, 2006

(87) PCT Pub. No.: WO2005/044580

PCT Pub. Date: May 19, 2005

(65) Prior Publication Data

US 2008/0075560 A1 Mar. 27, 2008

(30) Foreign Application Priority Data

Nov. 10, 2003 (JP) ..... 2003-380192

(51) Int. Cl.
*B42B 5/08* (2006.01)
*B42C 99/00* (2006.01)

(52) U.S. Cl. ..... 412/34; 412/33

(58) Field of Classification Search ..... 412/1, 412/6, 7, 11, 13, 33, 34, 38, 39, 40; 270/52.14, 270/52.17
See application file for complete search history.

(56) References Cited

U.S. PATENT DOCUMENTS 4,320,547 A * 3/1982 Stolle et al. ..... 412/40
4,610,590 A * 9/1986 Pigna ..... 412/11
6,873,426 B1 * 3/2005 Farrell ..... 358/1.15
2004/0018041 A1 * 1/2004 Amdahl et al. ..... 402/26

FOREIGN PATENT DOCUMENTS

EP 0 392 512 A 10/1990
EP 0 527 246 A 2/1993
JP UM-A-53-046215 4/1978
JP UM-A-04-076486 7/1992

(Continued)

OTHER PUBLICATIONS

Notification of Reason for Refusal, Feb. 8, 2008 by First Patent Examination Department, Amusement (Electric Game) Division. Chuetsu Ono Tel. 03-3581-1101 (Ext. 3264).

*Primary Examiner*—Dana Ross
*Assistant Examiner*—Pradeep C Battula
(74) *Attorney, Agent, or Firm*—Morgan, Lewis & Bockius LLP

(57) ABSTRACT

A binding processing apparatus 1 is provided with a punch mechanism 2 and a binding processing mechanism 3 for executing a binding processing by a binder. When a sheet P is fed from a printing apparatus 50 of a copier or the like, the sheet is butted to a stopper plate 9 of the punch mechanism, sheet aligning sliders 10 push both left and right sides thereof to position and punch holes are formed by a punch block 7 and a die 8. Thereafter, the sheet is fed to a sheet tray 15 of the binding processing mechanism, one set of the sheets are aligned and a ring shape binder is pinched by a pusher 17 to fit the ring shape binder to the punch holes of the sheets, and a brochure subjected to a binding processing is discharged to a stack tray 4. A binder cartridge 16 can contain a number of the binders and the binding processing can be executed continuously.

14 Claims, 5 Drawing Sheets

FOREIGN PATENT DOCUMENTS

| | | |
|---|---|---|
| JP | 5-501086 | 3/1993 |
| JP | 05-155173 | 6/1993 |
| JP | 08-026578 | 1/1996 |
| JP | 08-091686 | 4/1996 |
| JP | 10-247041 | 9/1998 |
| JP | A-11-020362 | 1/1999 |
| JP | 2000-001256 | 1/2000 |
| JP | B2-3437511 | 6/2001 |
| JP | A-2002-337474 | 11/2002 |
| JP | A-2003-212425 | 7/2003 |
| JP | A-2003-231092 | 8/2003 |
| JP | A-2003-266968 | 9/2003 |
| JP | A-2003-320780 | 11/2003 |
| WO | WO 02/42090 A | 5/2002 |

* cited by examiner

BINDING PROCESSING APPARATUS

TECHNICAL FIELD

The present invention relates to a binding processing apparatus for carrying out a series of processings until a sheet is formed with a punch hole and fitted with a ring type binder to bind.

BACKGROUND ART

There has been diffused a copier incorporating an electric stapler and a post processing function of subjecting each set of sheets successively fed from a copy mechanism to book binding by binding a set by a staple. Further, as a book binding by binding means other than a staple, there is also known book binding means of a coil binder, a comb binder comprising a series of rings in a comb-like shape or the like as means having a further excellent outlook and facilitating to handle and leaf pages. As the apparatus with an object of a binding processing connected to a copier as a post processing apparatus for binding sheets by the binding means, there is known a processing apparatus of successively receiving sheets which are copied or printed with images, forming punch holes at the sheets by a punching device and aligning the sheets (for example, JP-A-2003-231092, JP-B2-3437511), or a coil binding apparatus of fitting a coil binder to punch holes of sheets which are formed with the punch holes and aligned while rotating the coil binder (for example, JP-A-2002-337474).

Further, there has also been proposed a sheet post processing apparatus for successively receiving sheets which are copied or printed with images, forming punch holes by a punching device and adhering respective pages to each other by injecting a glue to the punch holes to bind (for example, JP-A-2003-266968).

Although according to the processing method of binding sheets by a coil binder, or a binder of a type of a series of rings, in comparison with the method of binding sheets by a staple or the method of binding sheets by a glue, there is achieved an advantage that an excellent outlook is provided and handling of sheets as a document is also facilitated, automation of a binder mounting operation is not easy, and there is not present a processing apparatus automating a series of binding processings from forming punch holes to fitting a binder.

Although according to the coil binding apparatus of JP-A-2002-337474, an object of automating to fit the coil is achieved, at each time of binding a copy of brochure, a single piece of coil needs to be mounted to the apparatus, which is not applicable to a use requesting an automatic continuous processing function (a use as a post processing apparatus of a copier or the like). Further, it is not easy to contain a number of coils in a cartridge or the like owing to the shape or constitute a continuous automatic feeding mechanism therefor and it is difficult to constitute a binding processing apparatus operated in cooperation with a copier or the like.

DISCLOSURE OF THE INVENTION

Hence, it is an object of the invention to provide a binding processing apparatus capable of continuously executing a series of binding processings from forming a punch hole to fitting a binder.

In order to achieve the above-described object, the invention provides a binding processing apparatus provided with: a punch mechanism for forming punch holes at a sheet by a punch and a die; and a binding mechanism for fitting a ring shape binder to the punch hole.

Further, the invention provides a binding processing apparatus provided with a punch mechanism for forming punch holes at a sheet by a punch and a die, a binding mechanism for fitting a ring shape binder to the punch holes, a feeding device for feeding the sheet after a punch process by the punch mechanism to a sheet tray, and discharging the sheet after fitting the ring shape binder to the punch holes of the sheet by the binding mechanism, and a controlling device for controlling the punch mechanism, the binding mechanism and the feeding device.

Further, the binding mechanism may be provided with a binder cartridge for accommodating ring shape binders stacked in front and rear direction. The ring shape binder at a frontmost row in the binder cartridge may be pinched from upper and lower sides to be fitted in a ring-like shape.

Further, a controlling device for executing the series of binding processing steps in cooperation with an external apparatus including a printing apparatus of a copier, a printer or the like, an automatic sheet feeding apparatus, a draft reading apparatus, or a collation apparatus or the like may be provided. A punch processing and a binder binding processing may be executed for the sheet discharged from the external apparatus.

Further, a punch processing selecting device for selecting to execute and stop the punch processing of the punch mechanism may be provided to be able to deal with the sheet previously formed with the punch hole.

Further, the punch processing selecting device may be operated by receiving a control data from an external apparatus of a printing apparatus of a copier, a printer or the like, an automatic sheet feeding apparatus, a draft reading apparatus, or a collation apparatus or the like.

Further, a binding processing selecting device for selecting to execute and stop the binding processing of the binding mechanism may be provided.

Further, the binding processing selecting device may be operated by receiving a control data from an external apparatus comprising a printing apparatus of a copier, a printer or the like, an automatic sheet feeding apparatus, a draft reading apparatus, or a collation apparatus or the like.

DESCRIPTION OF REFERENCE NUMERALS AND SIGNS

Figure 1:
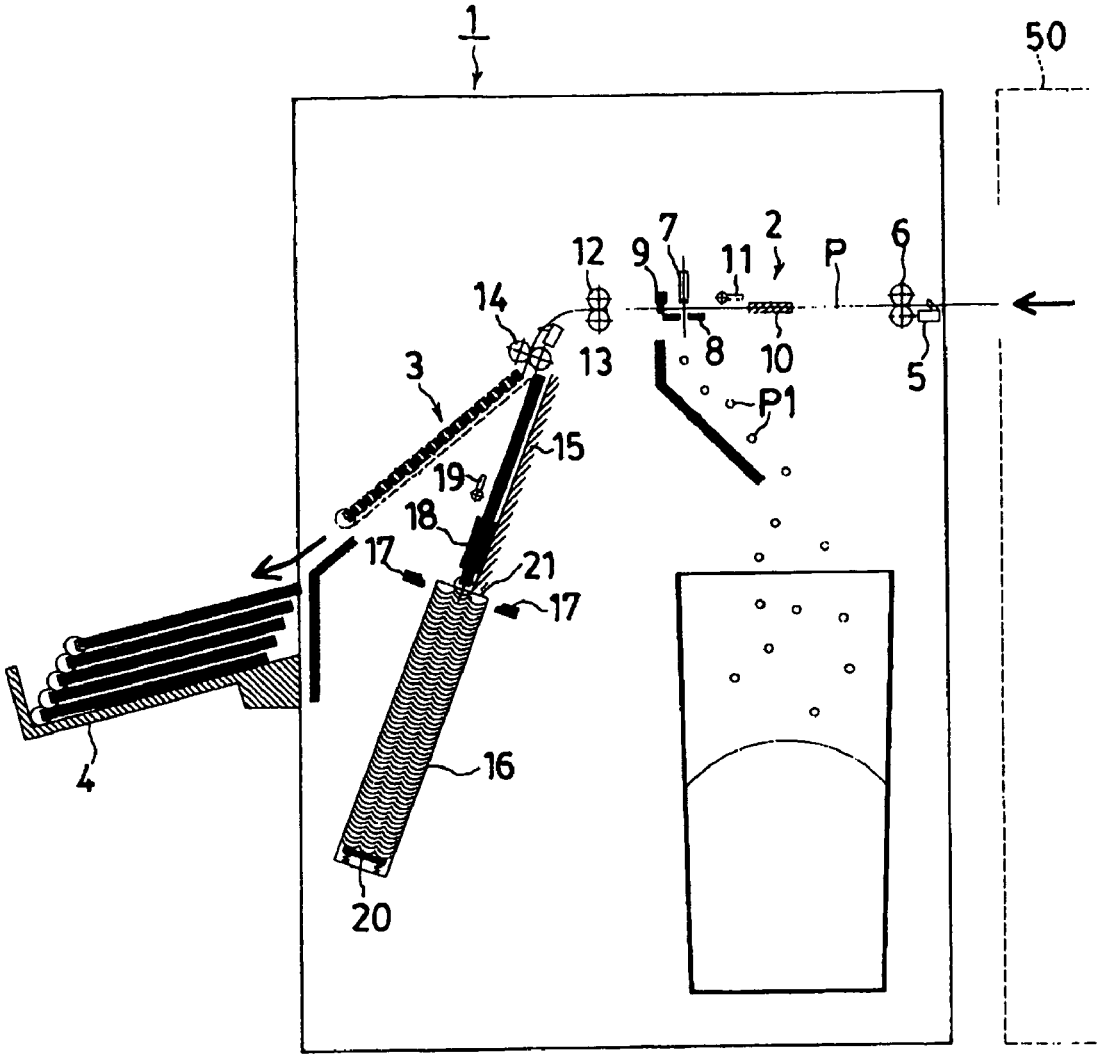
FIG. 1 is an explanatory view of a first exemplary embodiment of the invention showing a side sectional view of a binding processing apparatus.

Further, in notations in the drawings, numeral 1 designates a binding processing apparatus, numeral 2 designates a punch mechanism, numeral 3 designates a binding processing mechanism, numeral 4 designates a stack tray, numeral 5 designates a sheet detecting sensor, numeral 6 designates a sheet feeding roller, numeral 7 designates a punch block, numeral 8 designates a die, numeral 9 designates a stopper plate, numeral 10 designates a sheet aligning slider, numeral 11 designates a sheet feeding brush, numeral 12 designates a sheet feeding roller, numeral 13 designates a sheet detecting sensor, numeral 14 designates a sheet feeding roller, numeral 15 designates a sheet tray, numeral 16 designates a binder cartridge, numeral 17 designates a pusher, numeral 18 designates a sheet aligning slider, numeral 19 designates a sheet feeding brush, numeral 31 designates a binder, numeral 41 designates a binding processing apparatus, and numeral 50 designates an external apparatus.

BEST MODE FOR CARRYING OUT THE INVENTION

The invention will be explained in details as follows.

First Exemplary Embodiment

FIG. 1 shows a constitution of a binding processing apparatus 1 according to a first exemplary embodiment of the invention. Sheets printed by the printing apparatus 50 of a copier, a page printer or the like are successively fed to the binding processing apparatus 1 by a sheet feeding mechanism of the printing apparatus 50 and drawn into the binding processing apparatus 1. The binding processing apparatus 1 is a compound machine (ALL IN ONE MACHINE) integrated with a punch mechanism 2 and a binding processing mechanism 3. The sheets P fed from the printing apparatus 50 are formed with punch holes by the punch mechanism 2, fed to the binding processing mechanism 3, fitted with a series ring type binder at the punch holes by the binding processing mechanism 3 and discharged to the stack tray 4.

Details of binding processing apparatus 1 will be explained as follows. A sheet detecting sensor 5 and a pair of upper and lower sheet feeding rollers 6 are arranged at a vicinity of a sheet introducing port (right side of FIG. 1). Frontward from the sheet feeding rollers 6, there are arranged a series punch mechanism (punch mechanisms 7, 8) provided with a punch block 7 arranged in parallel with a plurality of punch pins at constant intervals and a die 8 formed with a plurality of circular holes in correspondence with the punch pins. Further, frontward from the series punch mechanism, a stopper plate 9 and a stopper plate lifting mechanism (not illustrated) are arranged. On both left and right sides of a sheet path rearward from the stopper plate 9, a pair of sheet aligning sliders 10, and an expanding and contracting mechanism (not illustrated) for sliding the sheet aligning sliders 10 symmetrically in a transverse direction (obverse and reverse direction of sheet face) are provided. Further, a sheet feeding brush 11 is provided on an upper side of a sheet path. That is, a first sheet feeding mechanism is constituted by the sheet feeding roller 6 and the sheet feeding brush 11.

When one sheet of the sheet P discharged from the printing apparatus 50 is brought into contact with the sheet detecting sensor 5 at an inlet of the binding processing apparatus 1, a control portion 51 drives the sheet feeding roller 6 to draw the sheet P, the sheet feeding brush 11 starts rotating to feed the sheet P to a front side, and a front end of the sheet P is butted to the stopper plate 9. Simultaneously therewith, the pair of left and right sheet aligning sliders 10 contract an interval therebetween to push the sheet P from both sides, thereby, a position of the sheet P in the front and rear direction and in the left and right direction is aligned.

After the positioning step, the punch block 7 is driven to move down, and a row of punch holes are punched at an edge portion of the sheet P by the punch block 7 and the die 8. After punching the punch holes, the punch block 7 is moved up, the pair of left and right sheet aligning sliders 10 expands the interval, the stopper plate 9 is moved up and positioning restriction is released. The sheet feeding brush 11 starts rotating again to feed the sheet P to the sheet feeding roller 12 on the front side and the sheet P is fed to the binding processing mechanism 3 by a sheet feeding roller 12 (that is, a second sheet feeding mechanism is constituted by the sheet feeding brush 11 and the sheet feeding roller.). Further, notation P1 designates a scrap of a sheet drawn by the punch mechanism 2.

An inlet of the binding processing mechanism 3 is arranged with a sheet detecting sensor 13 and a pair of sheet feeding rollers 14. Frontward from the sheet detecting sensor 13 and the sheet feeding rollers 14, a sheet tray 15 inclined in a front downward direction is arranged. A lower end of the sheet tray 15 is opposedly arranged with a binder cartridge 16. A pair of upper and lower pushers 17 are arranged upward and downward (leftward and rightward of FIG. 1) from a front end portion (upper side of FIG. 1) of the binder cartridge 16. The pair of upper and lower pushers 17 are moved up and down symmetrically by a feed screw mechanism or a cam mechanism. When operated to be proximate to each other, a frontmost row of a binder at inside of the binder cartridge 16 is pinched to bind the binder in a ring-like shape. Further, a pair of sheet aligning sliders 18 are provided on both left and right sides (obverse and reverse of FIG. 1) of the sheet tray 15 similar to the punch mechanism 2 and a sheet feeding brush 19 is provided on an upper side of the sheet tray 15. Further, although according to the above-described punch mechanism 2 of the embodiment, the sheet P is processed to be punched sheet by sheet, a plurality of sheets can also be processed by multiholes punching by a well-known means.

Figure 2:
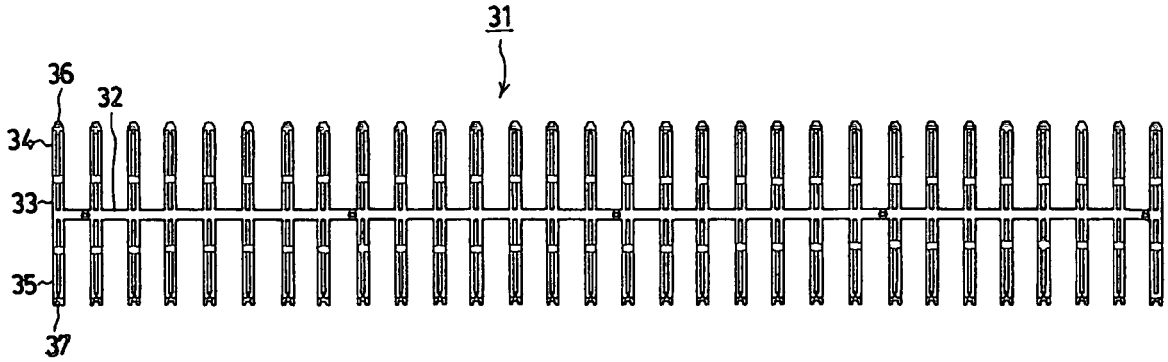
FIG. 2 shows a front view of a binder.
Figure 3:
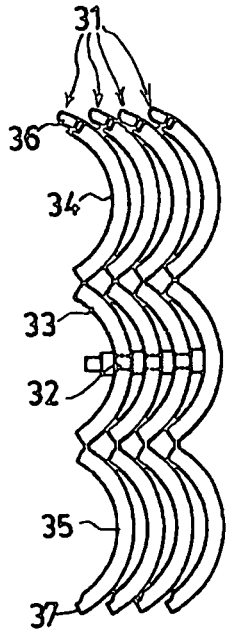
FIG. 3 shows a side view of stacking a plurality of binders in a front and rear direction.

FIG. 2 and FIG. 3 show the binder 31, FIG. 2 is a front view, FIG. 3 is a side view of stacking of the plurality of binders 31 in a front and rear direction. The binder 31 is a resin injection molding product in which ring portions are aligned at a spine portion 32 having a length in accordance with a dimension of a constant shape sheet at constant intervals. The ring portion is divided in three of a center ⅓ ring portion 33 coupled to the spine portion 32 and ⅓ ring portions 34, connected to upper and lower sides thereof.

A front end of the upper side ⅓ ring portion 34 is formed with a hook portion 36, and a front end of the lower side ⅓ ring portion 35 is formed with a catch portion 37 to be fitted with the hook portion 36. The ring is formed by fitting the front ends to each other by folding to bend the upper and the lower ⅓ ring portion 34, 35. At the center ⅓ ring portion 33, curvatures of an outer peripheral face and an inner peripheral face thereof are formed to be substantially equal to each other. In an initial state, respective both ends of the three ⅓ ring portions 33, 34, 35 are aligned substantially on a straight line. Thereby, when a plurality of binders are stacked as shown by FIG. 3, clearances are hardly produced thereamong. Therefore, the stacked binders are contained in the binder cartridge 16 with excellent space efficiency.

Figure 4:
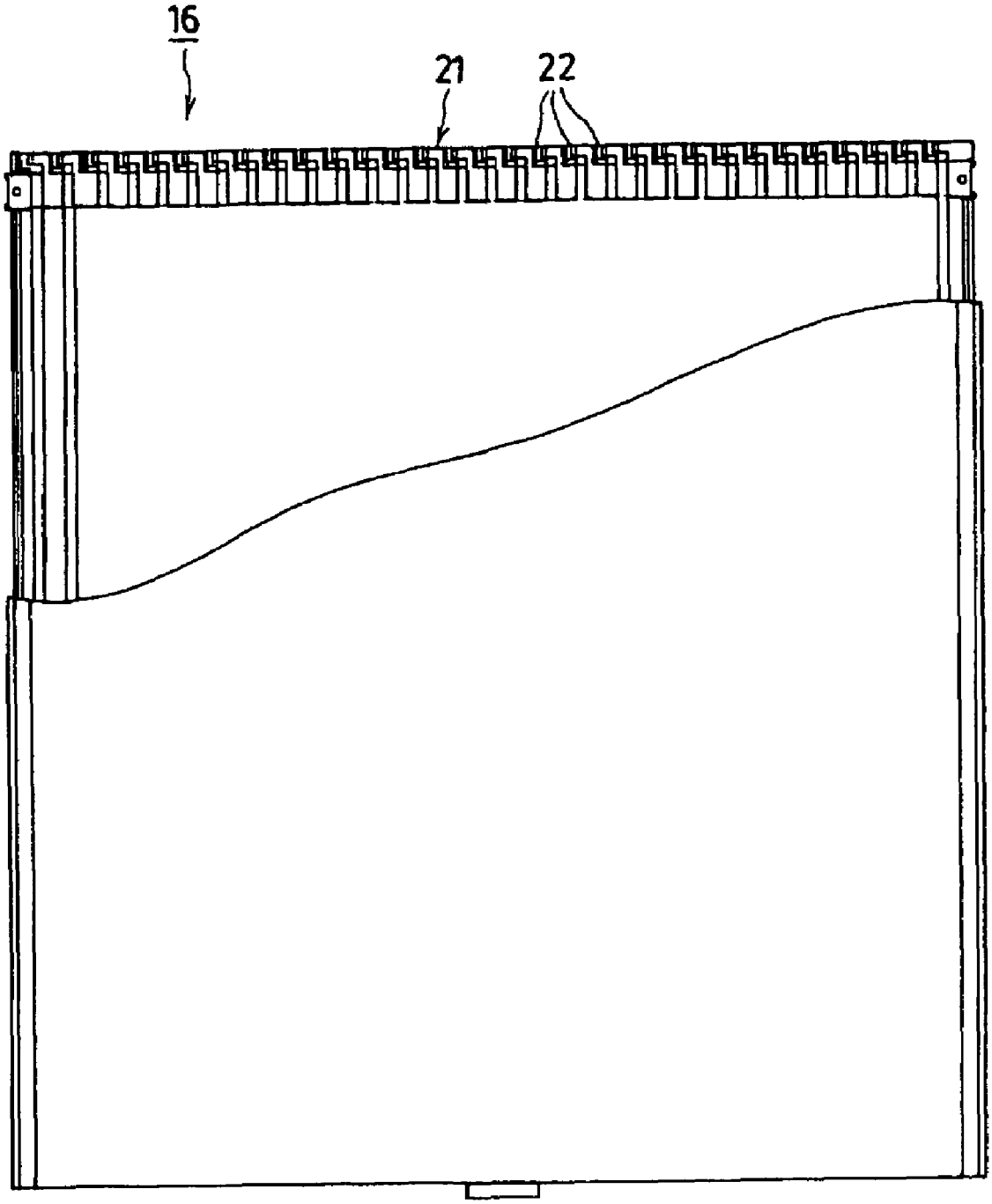
FIG. 4 shows a plane view of a binder cartridge.

The binder cartridge 16 is provided with a binder pusher 20 of a spring type. The binder pusher 20 is brought into contact with the binder 31 at a rearmost row to push the binder 31 frontward (upward of FIG. 1) and the binder 31 at a frontmost row is brought into elastic contact with a gate portion 21. As shown by FIG. 4, the gate portion 21 of the binder cartridge 16 is formed with a guide groove 22 in correspondence with each ring portion of the binder 31. The guide groove 22 is bent in a crank shape in view from upper side. By sliding the binder 31 at the frontmost row along the guide groove 22 of the crank shape by a lateral slider (not illustrated), only the binder 31 at the frontmost row can be taken out from the binder cartridge 16.

The sheet P fed out from the punch mechanism 2 is fed to the sheet feeding rollers 12, 14, dropped onto the sheet tray 15, pushed to a side of the binder cartridge 16 by a sheet feeding brush 19 and is pushed by the sheet aligning sliders 18 from left and right sides to align after one set of the sheets P are fed to the sheet tray.

Further, the pair of upper and lower pushers 17 are closed to pinch the binder 31 at the frontmost row from upper and lower sides, the upper and the lower ⅓ ring portions of the binder 31 are inserted into the punch holes of one set of sheets to be fitted and the binder 31 is fitted to one set of sheets. After finishing to fit the binder, the pushers 17 are separated to return to initial positions, the sheet tray 15 is pivoted upward and a brochure subjected to the binding processing on the sheet tray 15 is slid to drop on the stack tray 4 and stacked on the stack tray 4.

Figure 5:
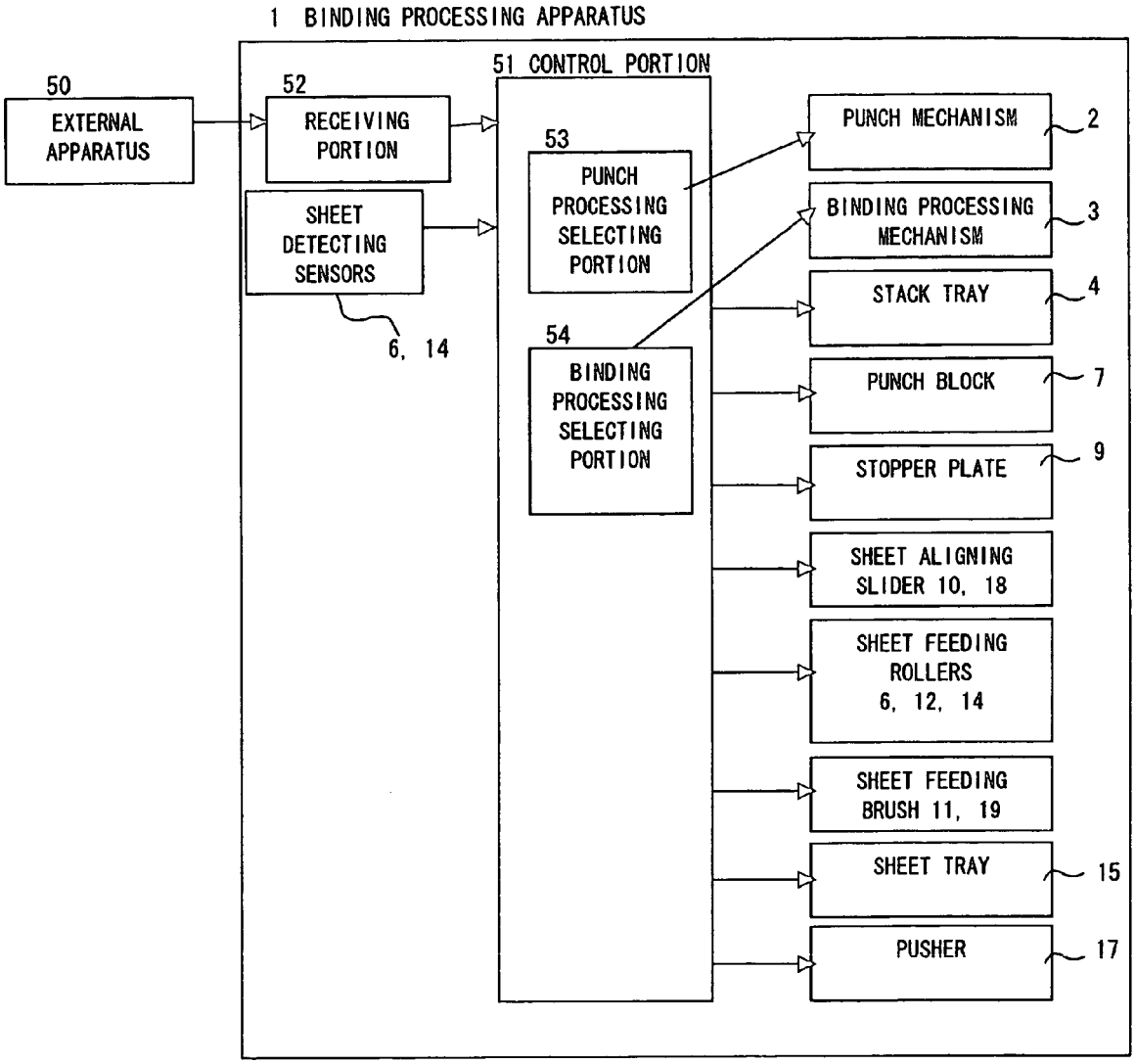
FIG. 5 shows a schematic diagram of controlling the binding processing apparatus.

FIG. 5 shows a schematic control diagram of the binding processing apparatus 1 according to the exemplary embodiment. The binding processing apparatus 1 is provided with a control portion 51. The control portion 51 receives signals at inside of the binding processing apparatus of signals from the sheet detecting sensors 6,14 and the like. Further, the control portion 51 receives a signal from the printing apparatus 50 as an external apparatus by way of a receiving portion 52. The external apparatus 50 may be an automatic sheet feeding apparatus, a draft reading apparatus, or a collation apparatus or the like other than a printing apparatus of a copier, a printer or the like. The control portion 51 includes a punch processing selecting portion 53 for selecting to execute and stop a punching processing of the punch mechanism 2 and a binding processing selecting portion 54 for selecting to execute and stop the binding processing of the binding mechanism 3. Further, the control portion 51 controls the punch mechanism 2, the binding processing mechanism 3, the stack tray 4, the sheet feeding rollers 6, 12, 14, the punch block 7, the stopper plate 9, the sheet aligning sliders 10, 18, the sheet feeding brushes 11, 19, the sheet tray 15, and the pusher 17 and the like in accordance with the signals at inside of the binding processing apparatus of the signals from the sheet detecting sensors 6, 14 and the like and the signal from the external apparatus 50 received by way of the receiving portion 52.

Further, when the means for selecting to execute and stop to operate the punch mechanism is provided as a controlling device for controlling the binding steps by a sequential control, only the binder is mounted without duplicatedly working the punch hole to the sheet previously formed with the punch hole. Further, when the means for selecting to execute and stop the operation of the punch mechanism is constituted to be operated by receiving control data from a printing apparatus of a copier, a printer or the like, an artificial selecting operation is dispensed with.

Second Exemplary Embodiment

Figure 6:
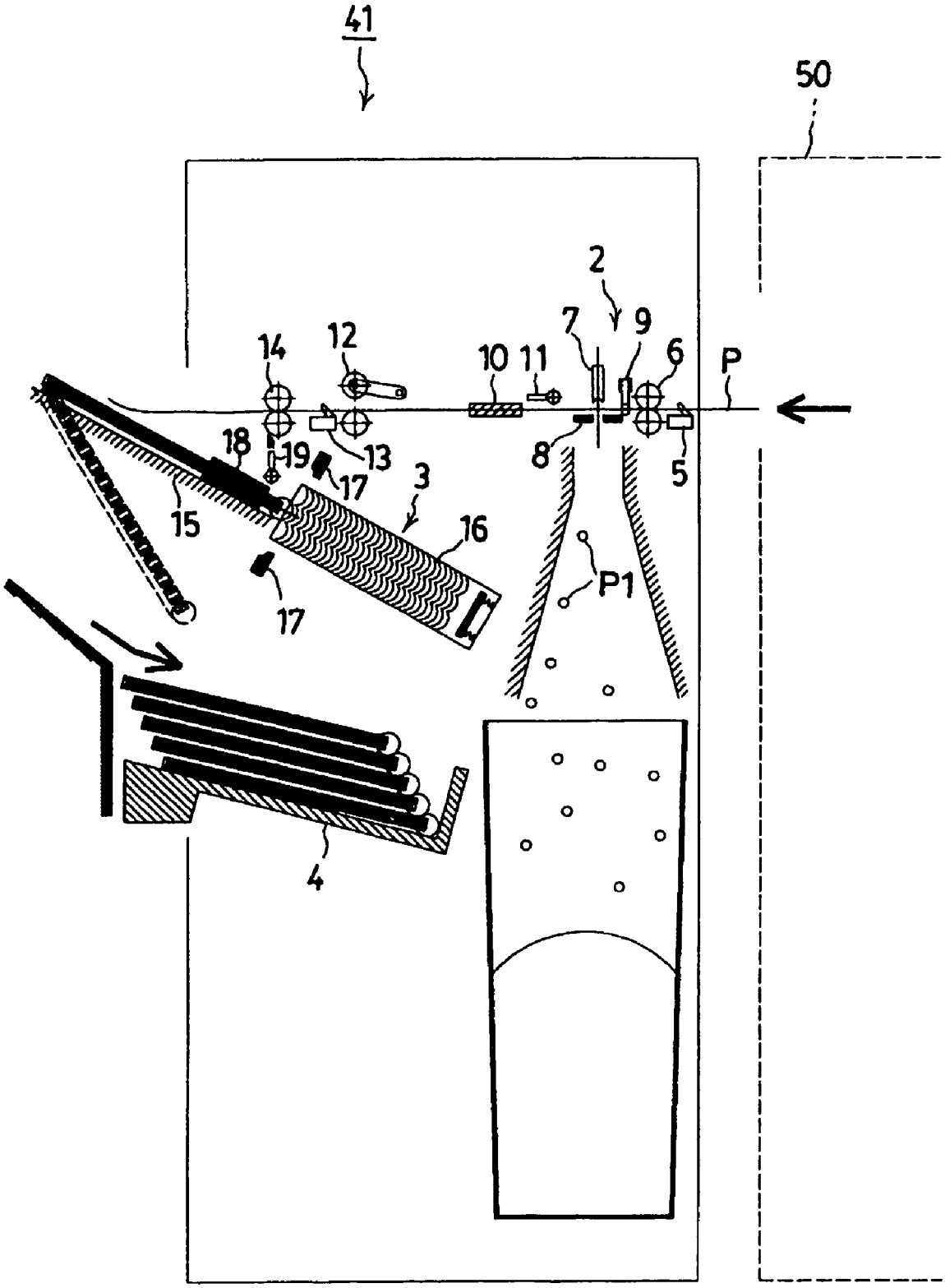
FIG. 6 is an explanatory view of a second exemplary embodiment of the invention and is a side sectional view of a binding processing apparatus.

FIG. 6 shows the binding processing apparatus 41 according to a second exemplary embodiment of the invention. Although the binding processing apparatus 41 is constructed by a constitution basically the same as that of the binding processing apparatus 1 of the first exemplary embodiment, whereas the punch holes are formed on the front side in the direction of feeding the sheet according to the first exemplary embodiment, according to the binding processing apparatus 41 of the second exemplary embodiment, the punch holes are formed on the rear side in the direction of feeding the sheet. The series punch mechanism comprising the punch block 7 and the die 8 and the stopper plate 9 are arranged to be proximate to the introducing port of sheets. When the sheet is fed by the sheet feeding roller 6, the stopper plate 9 is moved up and does not hinder the sheet P from passing and the stopper plate 9 is moved down after the sheet P has completely been fed. Thereafter, the sheet feeding brush 11 is reversely rotated to move the sheet P reversely, the rear end of the sheet P is butted to the stopper plate 9, the interval of the pair of left and right sheet aligning sliders 10 is contracted to push the sheet P from both sides, and a row of the punch holes are punched at the edge portion of the sheet P by the punch block 7 and the die 8. After punching the punch hole, the punch block 7 is moved up, the interval of the pair of left and right sheet aligning sliders 10 is expanded and the stopper plate 9 is moved up, the sheet feeding brush 11 is rotated regularly to feed the sheet P to the sheet feeding rollers 12, 14 frontward therefrom, and the sheet P is drawn by the sheet feeding rollers 12, 14 to be dropped onto the sheet tray 15 of the binding processing mechanism 3.

The constitution and the operation of the binding processing mechanism 3 are similar to those of the first exemplary embodiment. The sheet P fed out from the punch mechanism 2 and dropped onto the sheet tray 15 is pushed to the side of the binder cartridge 16 by the sheet feeding brush 19. After feeding one set of the sheets P to the sheet tray 15, the sheets are pushed from left and right sides by the sheet aligning sliders 18 to align one set of the sheets P. Further, the pair of upper and lower pushers 17 are closed to pinch the binder 31 at the frontmost row from upper and lower sides, the upper and the lower ⅓ ring portions of the binder 31 are inserted into the punch holes of the one set of sheets P to fit front ends of the ring portion, and the binder 31 is fitted to the one set of sheets P. After finishing to mount the binder, the pushers 17 are separated to upper and lower sides to return to initial positions, the sheet tray 15 is pivoted to the lower side and the brochure subjected to the binding processing on the sheet tray 15 is slid to drop to the stack tray 4 and laminated on the stack tray 4.

Although an explanation has been given of the invention in details and in reference to the specific exemplary embodiments, it is apparent for the skilled person that the invention can variously be changed or modified without deviating from the spirit and the range of the invention.

The present application is based on Japanese Patent Application (P.2003-380192) filed on Nov. 10, 2003 and contents of which are incorporated herein by reference.

INDUSTRIAL APPLICABILITY

According to the embodiments of the invention, an efficiency of the binding processing apparatus is significantly promoted by integrating the punch mechanism for forming the punch hole at the sheet by the punch and the die, and the binding processing mechanism for fitting the ring shape binder to the punch holes and cooperating the punch hole processing working and the binding processing by the binder.

Further, when a controlling device for executing the series of binding processing steps in cooperation with an external apparatus comprising a printing apparatus of a copier, a printer or the like, an automatic sheet feeding apparatus, a draft reading apparatus, or a collation apparatus or the like is provided, all the steps from printing to binding processing by the binder can be automated.

Further, by providing the punch processing selecting device for selecting to execute and stop the punch processing of the punch mechanism, punch hole working can be omitted for sheets previously formed with punch holes of loose leaf sheets or the like and the punch holes can be prevented from being worked duplicatedly.

Further, by constituting the punch processing selecting device for selecting to execute and stop the punch processing of the punch mechanism to operate by receiving control data from an external apparatus comprising a printing apparatus of a copier, a printer or the like, an automatic sheet feeding apparatus, a draft reading apparatus, or a collation apparatus or the like, the punch mechanism is automatically controlled to operate to execute and stop in accordance with sheets.

Further, the invention can be used also as an ordinary sheet processing apparatus which does not execute binding processing by the binding processing selecting means for selecting to execute and stop the binding processing of the binding mechanism.

Further, by constituting the binding processing selecting device to operate by receiving control data from the external apparatus comprising a printing apparatus of a copier, a printer or the like, an automatic sheet feeding apparatus, a draft reading apparatus, or a collation apparatus or the like, the binding processing is automatically controlled to execute and stop in accordance with sheets.

The invention achieves the object of automating the punch hole working through the binding processing by the binder by integrating the binding processing apparatus comprising the punch hole binding mechanism, the punch mechanism for forming the punch hole at the sheet by the punch and the die, and the binding processing mechanism for mounting the ring shape binder to the punch hole.

The invention claimed is:

1. A binding processing apparatus, comprising:

a punch mechanism that forms punch holes at a sheet by a punch and a die; and a binding mechanism that fits a ring shape binder to the punch holes, wherein ring shape binders are stacked such that respective ends of ring portions of the ring shape binder are substantially aligned on a straight line and contained in a binder cartridge and the ring shape binders are pushed to a binding position by a spring provided in the cartridge, the binding mechanism comprises a pair of pushers, each of said ring portions of the ring shape binder comprise a center ring portion and first and second ring portions connected to respective ends of the center ring portion, and the first and second ring portions are pinched by the pair of pushers, and respective ends of the first and second ring portions are fitted in a corresponding one of the punch holes.

2. The binding processing apparatus according to claim 1, wherein the ring shape binder includes a spine portion and ring portions aligned at the spine portion at constant intervals.

3. The binding processing apparatus according to claim 1, further comprising:

a feeding device that feeds the sheet to the punch mechanism, feeds the sheet after a punch process by the punch mechanism to a sheet tray and discharges a set of sheets with the ring shape binder fitted in the punch holes by the binding mechanism; and a controlling device that controls the punch mechanism, the binding mechanism and the feeding device.

4. The binding processing mechanism according to claim 1, further comprising:

a first sheet feeding mechanism that feeds the sheet to the punch mechanism; and a second sheet feeding mechanism that feeds the sheet after a punch process by the punch mechanism to the binding mechanism.

5. The binding processing apparatus according to claim 1, wherein the binding mechanism pinches the ring shape binder positioned at a front most row in the binder cartridge and fits the ring shape binder to the sheet in a ring-like shape.

6. The binding processing apparatus according to claim 1, further comprising:

a controlling device for controlling the punch mechanism and the binding mechanism in cooperation with an external apparatus.

7. The binding processing apparatus according to claim 6, wherein the controlling portion includes a receiving portion for receiving a signal from the external apparatus.

8. The binding processing apparatus according to claim 6, wherein the external apparatus is one of a printing apparatus, an automatic sheet feeding apparatus, a draft reading apparatus and a collation apparatus, and a punch process and a binder binding process are executed for the sheet discharged from the external apparatus.

9. The binding processing apparatus according to claim 1, further comprising:

a punch processing selecting portion that selects to execute and stop a punch processing of the punch mechanism.

10. The binding processing apparatus according to claim 9, wherein the punch processing selecting portion is operated by receiving a control data from an external apparatus.

11. The binding processing apparatus according to claim 10, wherein the external apparatus is one of a printing apparatus, an automatic sheet feeding apparatus, a draft reading apparatus, and a collation apparatus.

12. The binding processing apparatus according to claim 1, further comprising:

a binding processing selecting portion that selects to execute and stop a binding processing of the binding mechanism.

13. The binding processing apparatus according to claim 12, wherein the binding processing selecting portion is operated by receiving a control data from the external apparatus.

14. The binding processing apparatus according to claim 13, wherein the external apparatus is one of a printing apparatus, an automatic sheet feeding apparatus, a draft reading apparatus, and a collation apparatus.

* * * * *